US005909872A

United States Patent [19]

Takahashi

[11] Patent Number: 5,909,872

[45] Date of Patent: Jun. 8, 1999

[54] SHEET SUPPLYING APPARATUS WITH SHIFT AND AUXILIARY SHIFT FOR SHEET SUPPORT

[75] Inventor: Koji Takahashi, Toride, Japan

[73] Assignee: Canon Kabushiki Kaisha, Tokyo, Japan

[21] Appl. No.: 08/697,665

[22] Filed: Aug. 28, 1996

[30] Foreign Application Priority Data

Aug. 28, 1995 [JP] Japan ..... 7-242529
Sep. 26, 1995 [JP] Japan ..... 7-247979

[51] Int. Cl.[6] ..... B65H 3/06

[52] U.S. Cl. ..... 271/116; 271/117; 271/127

[58] Field of Search ..... 271/114, 116, 271/117, 118, 126, 127

[56] References Cited

U.S. PATENT DOCUMENTS

| | | | |
|---|---|---|---|
| 4,346,878 | 8/1982 | Aizawa . | |
| 4,717,139 | 1/1988 | Sootome et al. | 271/126 |
| 5,201,873 | 4/1993 | Kikuchi et al. | 271/127 X |
| 5,219,155 | 6/1993 | Kanome | 271/127 |
| 5,290,024 | 3/1994 | Takahashi . | |
| 5,386,983 | 2/1995 | Ando | 271/118 |
| 5,474,287 | 12/1995 | Takahashi . | |

FOREIGN PATENT DOCUMENTS

| | | | |
|---|---|---|---|
| 0 567 112 | 10/1993 | European Pat. Off. . | |
| 193830 | 7/1990 | Japan | 271/114 |

OTHER PUBLICATIONS

Patent Abstracts of Japan, vol. 008, No. 116 (M–299), May 30, 1984 & JP 59–022830 (Ricoh KK), Feb. 6, 1984.

*Primary Examiner*—Boris Milef
*Attorney, Agent, or Firm*—Fitzpatrick, Cella, Harper & Scinto

[57] ABSTRACT

The present invention provides a sheet supplying apparatus having a sheet support for supporting sheets, a sheet supply roller for feeding out the sheet on the sheet support, a drive unit generating normal and reverse rotating forces, for driving the sheet supply roller, a shift unit for shifting the sheet support between a sheet supply position and a waiting position, a one-way clutch for transmitting a rotating force generated by the drive unit to the shift unit, and an auxiliary shift device for shifting the sheet support in a direction opposite to a shifting direction of the sheet support by the shift unit through a rotating force when the reverse rotating force is generated by the drive unit.

23 Claims, 17 Drawing Sheets

10
7
8b
9
8
4
6
5
4a
2c
2a
15a
11
13
12
16
3
2
15
15b
2b
15c

SHEET SUPPLYING APPARATUS WITH SHIFT AND AUXILIARY SHIFT FOR SHEET SUPPORT

BACKGROUND OF THE INVENTION

1. Field of the Invention

The present invention relates to a sheet supplying apparatus used with an image forming apparatus such as a facsimile, a printer and the like and adapted to supply a sheet or an original to an image forming portion or an image reading portion.

2. Related Background Art

There has been proposed a sheet supplying apparatus in which a plurality of sheets are set and are successively supplied to an image forming portion, or a sheet is supplied to the image forming portion from an intermediate tray for temporarily holding the sheets. This is to form an image of a rear surface of the sheet having a front surface on which the image was already formed or originals are successively supplied to an image reading portion, as shown in FIGS. 15A and 15B. FIG. 15A shows a waiting condition of the sheet supplying apparatus, and FIG. 15B shows a condition that the sheets are being supplied.

In such a sheet supplying apparatus, the sheets stacked on an intermediate plate 503 are successively separated and supplied by a separation roller 501 and a separation pad 502 urged against the separation roller. In the waiting condition of the sheet supplying apparatus, as shown, the intermediate plate 503 is pushed downwardly by a cam (not shown) to separate it from the separation roller 501. Thus, the sheets can be set on the intermediate plate 503.

When a sheet supplying operation is started, the cam pushing the intermediate plate 503 downwardly is rotated by a clutch means (not shown) such as a solenoid, with the result that the cam is disengaged from the intermediate plate 503, thereby lifting the intermediate plate 503 by a spring 504. Consequently, an uppermost sheet on a sheet stack rested on the intermediate plate 503 is urged against the separation roller 501. When the separation roller 501 is rotated, the sheets are fed out. Then, the sheets are separated one by one between the separation roller and the separation pad 502 and the separated sheet is sent to a downstream image forming portion or a downstream image reading portion.

However, in the sheet supplying apparatus having such a construction, a drive source for driving the cam must be provided independently from a drive source for driving the separation roller. Or, when a common drive source for driving the separation roller and the cam is used, a drive switching mechanism such as a solenoid or an electromagnetic clutch for selectively switching connections so that a driving force from the drive source can be transmitted only when it is requested must be provided. Thus, the apparatus is made complicated or is expensive.

In order to solve such a problem, there has been proposed a sheet supplying apparatus as disclosed in U.S. Pat. No. 5,219,155. Such a sheet supplying apparatus will be explained with reference to FIGS. 16A through 17. FIG. 16A shows a condition that, in a normal rotation of a motor (not shown), when a cam 204 is rotated in a direction shown by the arrow D to release regulation of an intermediate plate 202, the intermediate plate 202 is pushed upwardly by a pressure spring 212 to a sheet supply permitting position, and FIG. 16B shows a condition that, by rotating the motor in a reverse direction to rotate the cam 204 in a direction shown by the arrow C, the intermediate plate 202 is pushed downwardly in opposition to the pressure spring 212 to a waiting position.

A separation roller 200 is connected to the reversible motor so that, by rotating the motor, the cam 204 is driven to lift or lower the intermediate plate 202 on which a sheet stack is rested. A driving force of the motor is transmitted from a drive shaft 200*a* of the separation roller 200 to a clutch 210 (FIG. 17) through gears 206 and 208. The cam 204 is connected to the clutch 210 to be appropriately controlled by it.

The clutch 210 has a construction as shown in FIG. 17 so that, when the motor is rotated in the normal direction, a clutch spring 214 is loosened not to transmit the driving force to the cam 204, and, when the motor is rotated in the reverse direction, the driving force is transmitted to the cam 204. Further, the cam 204 is urged against a side surface of the gear 208 by an urging spring 216.

With this arrangement, during the sheet supply, when the motor is rotated in the normal direction, the separation roller 200 is rotated and the cam 204 is rotated in the direction D through the clutch 210, with the result that the intermediate plate 202 is lifted to urge the sheet stack against the separation roller 200. In this case, since the clutch spring 214 of the clutch 210 is loosened, the driving force is not transmitted by the clutch spring 214, but, the cam 204 is rotated due to a friction force between the cam and the gear 208.

After the sheet supplying operation is finished, the motor is rotated in the reverse direction to rotate the cam 204 in the direction C (FIGS. 16A and 16B) through the clutch 210, to thereby lower the intermediate plate 202. When the intermediate plate 202 is completely lowered by the cam 204, this condition is detected by a sensor (not shown) to stop the motor. In this way, by utilizing the normal and reverse rotations of the motor for driving the separation roller 200, the lifting/lowering of the intermediate plate 202 can be controlled.

However, in the sheet supplying apparatus having such a construction, when the intermediate plate 202 is lifted, since the cam 204 is rotated by utilizing the friction force between the cam 204 and the gear 208, the intermediate plate 202 cannot be lifted and lowered, if the friction force is small, which causes the poor sheet supply.

SUMMARY OF THE INVENTION

An object of the present invention is to provide a sheet supplying apparatus in which a sheet can surely be supplied automatically with simple construction and control without requiring independent drive sources.

To achieve the above object, according to the present invention, there is provided a sheet supplying apparatus which comprises a sheet supporting means for supporting sheets, a sheet supply means for feeding out the sheet supported by the sheet supporting means, a drive means for driving the sheet supply means and for generating normal and reverse rotating forces, a shift means for shifting the sheet supporting means between a sheet supply position where the sheet supported by the sheet supporting means is contacted with the sheet supply means and a waiting position where the sheet is spaced apart from the sheet supply means, a clutch means for transmitting a one-way rotating force generated by the drive means to the shift means, and an auxiliary shift means for forcibly shifting the sheet supporting means in a direction opposite to a shifting direction of the sheet supporting means shifted by the shift means through a rotating force transmitted by the clutch means when the reverse rotating force is generated by the drive means.

DETAILED DESCRIPTION OF THE PREFERRED EMBODIMENTS

Figure 13:
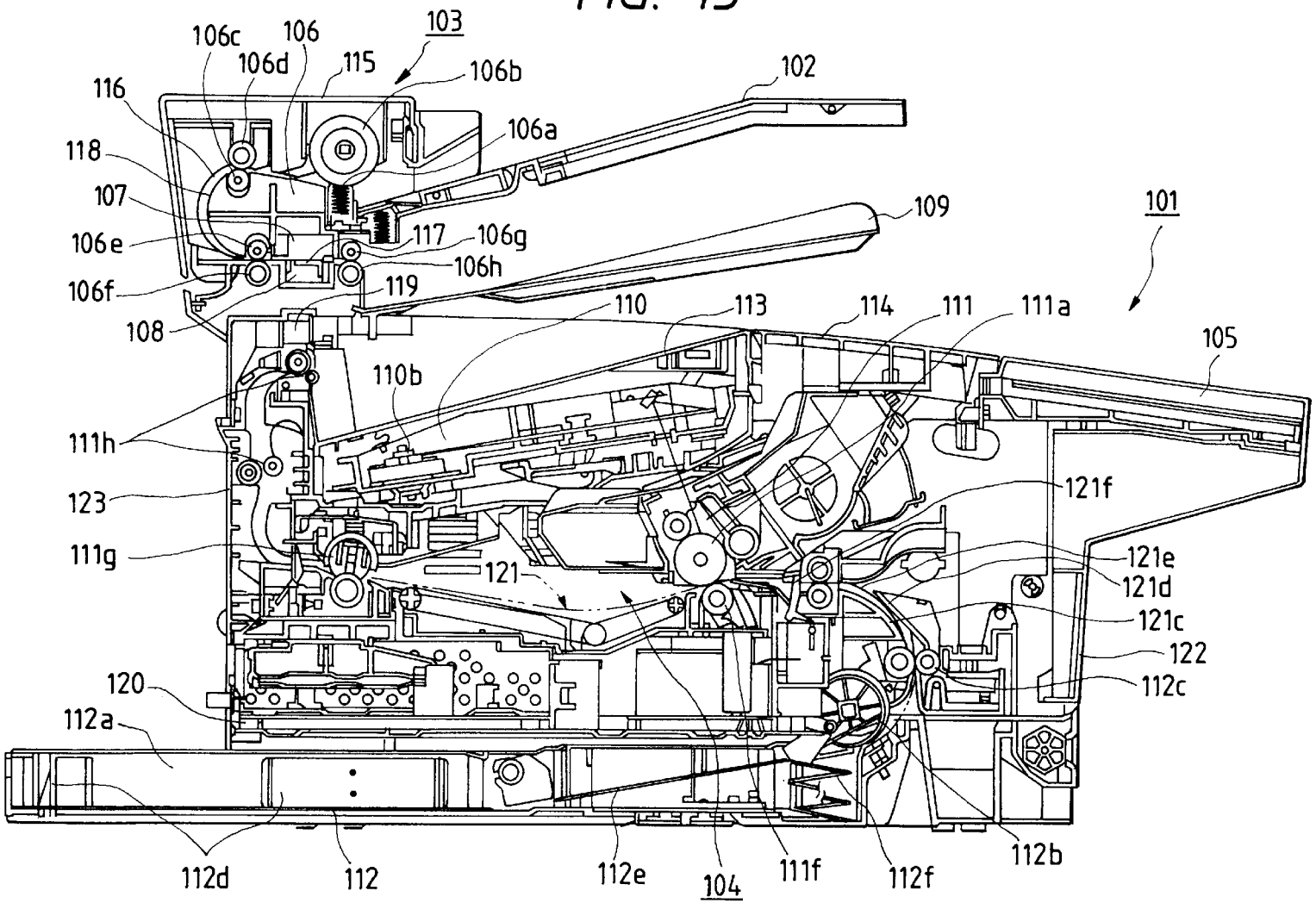
FIG. 13 is a sectional view showing an example of a facsimile to which the present invention is applied.
Figure 14:
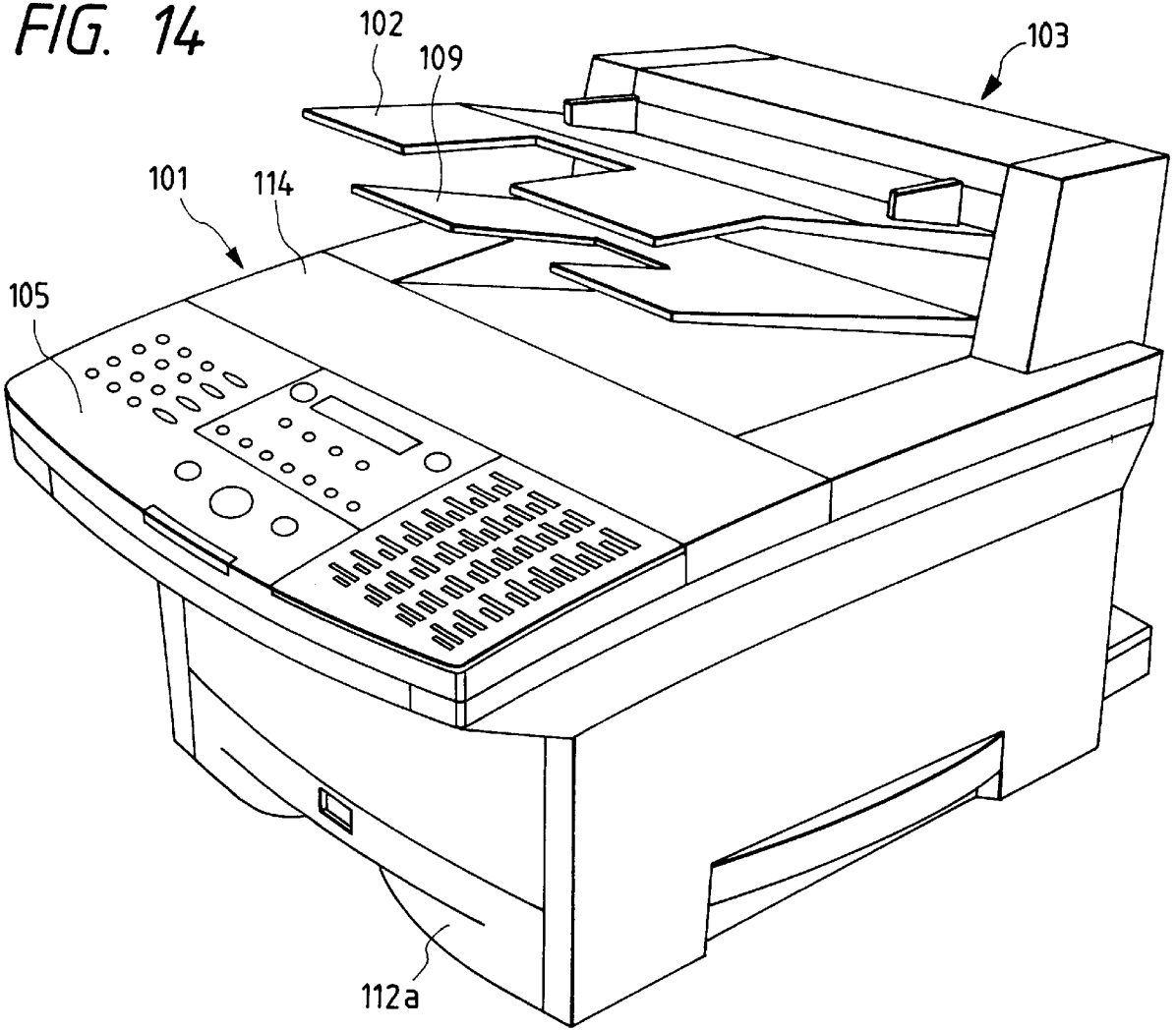
FIG. 14 is a perspective view of the facsimile of FIG. 13.
Figure 15A:
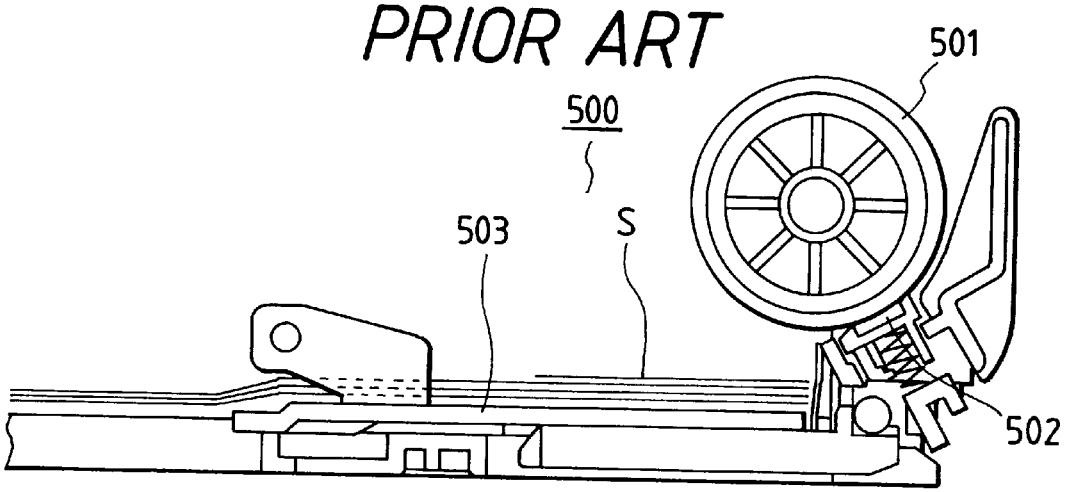
FIG. 15A PRIOR ART
FIGS. 15A and 15B are sectional views showing an example of a conventional sheet supplying apparatus.
Figure 15B:
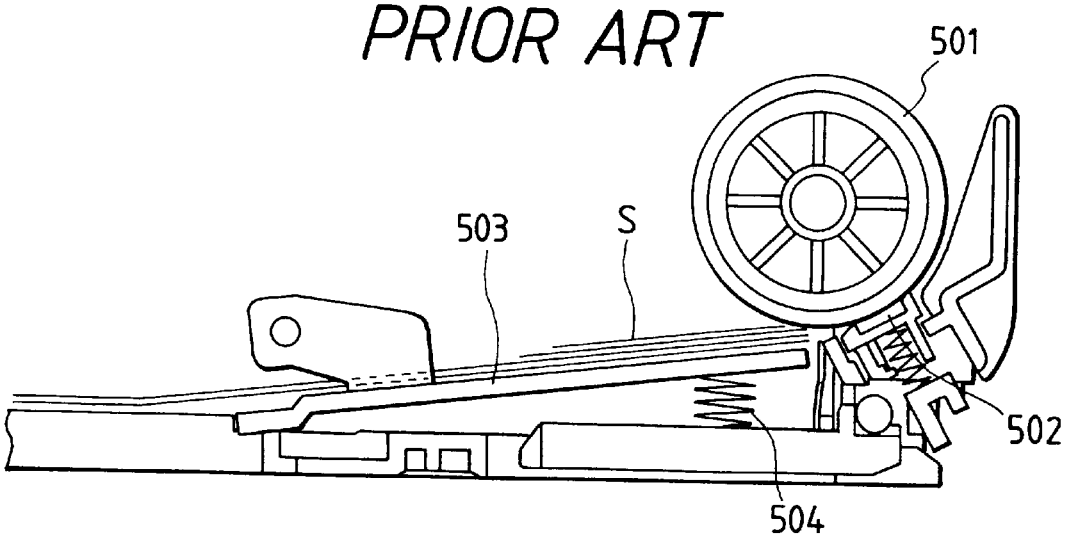
FIG. 15B PRIOR ART
Figure 16A:
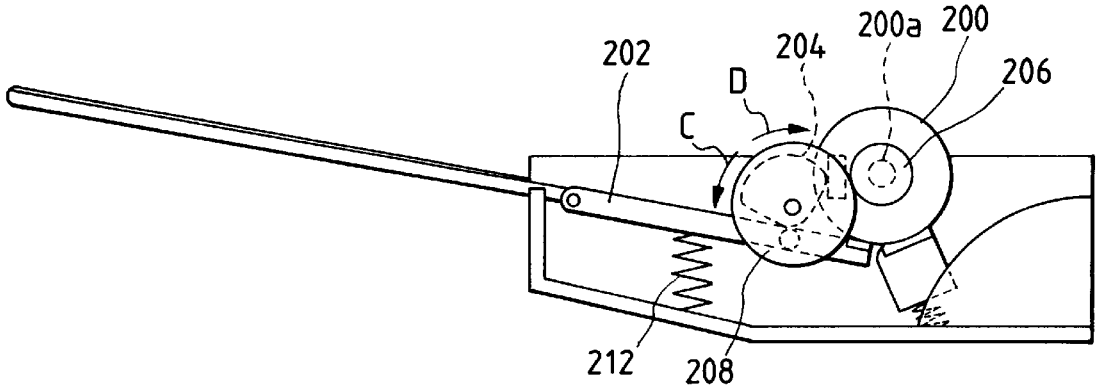
FIG. 16A PRIOR ART
FIGS. 16A and 16B are sectional views showing another example of a conventional sheet supplying apparatus.
Figure 16B:
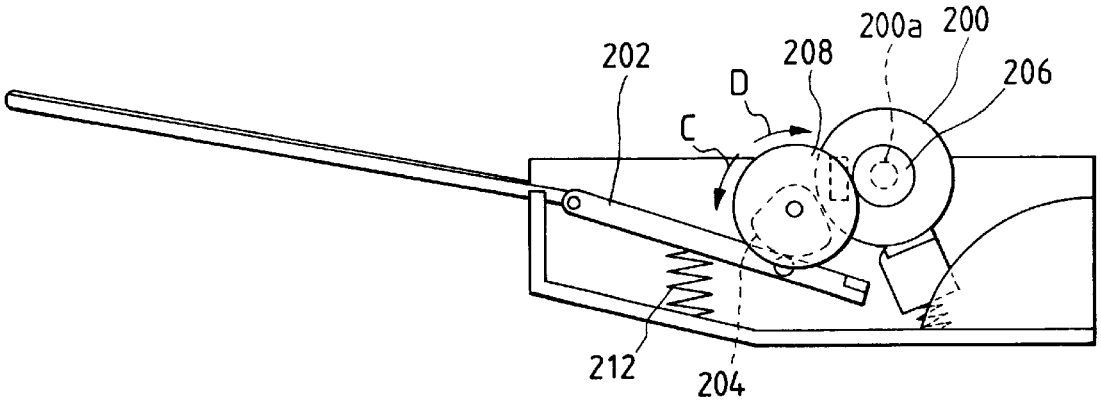
FIG. 16B PRIOR ART
Figure 17:
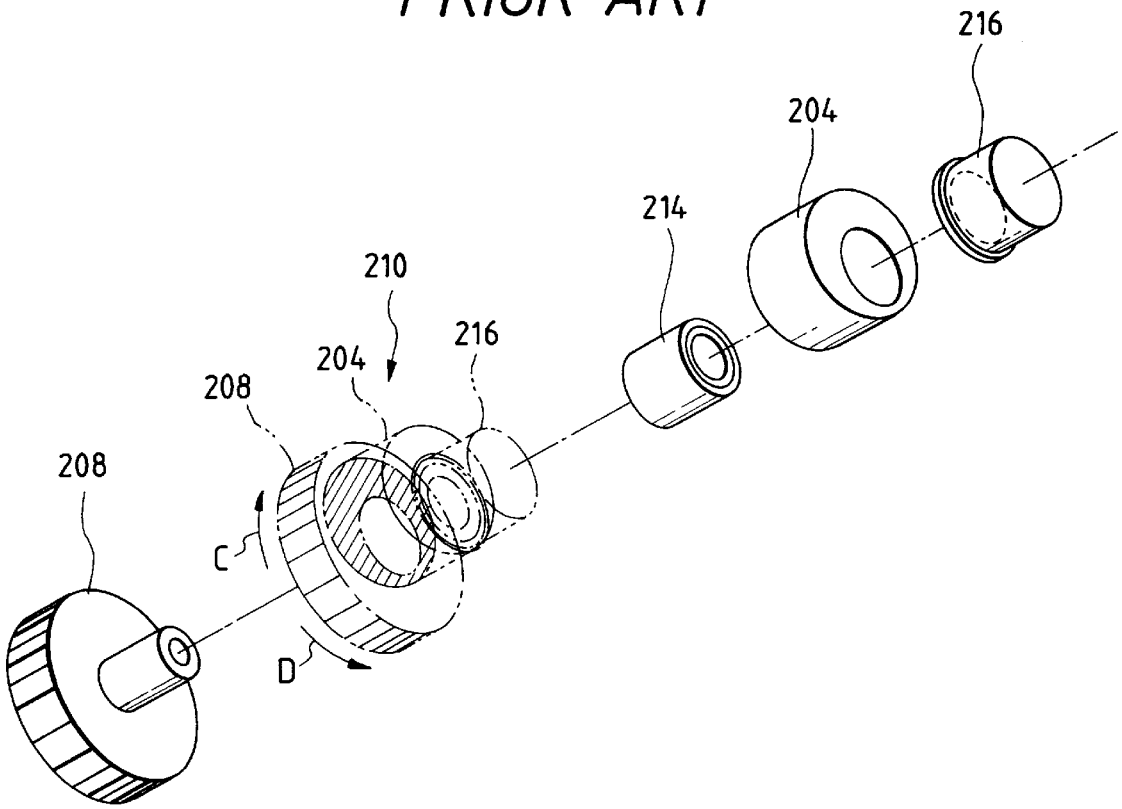
FIG. 17 PRIOR ART
FIG. 17 is a perspective view of a clutch used with the sheet supplying apparatus shown in FIGS. 16A and 16B.

FIG. 13 is a sectional view showing a facsimile as an example of an image forming apparatus to which the present invention is applied, and FIG. 14 is a perspective view of it. First of all, a construction and an operation of the facsimile will be explained with reference to FIGS. 13 and 14.

In FIG. 13, a facsimile machine 101 comprises an original stacking plate 102 on which a plurality of originals S can be stacked, an image reading portion 103 for reading image information on the original, a recording apparatus 104 comprised of an electrophotographic laser beam printer, an operation portion 105 including a display portion and input keys, an original conveying portion 106, an original urging portion 107, an image sensor 108 of close contact type, an original discharge tray 109, a laser scanner 110, and an image forming portion 111.

The facsimile machine further comprises a cassette sheet supply portion 112, a sheet discharge portion 113 formed on an upper cover of it and capable of receiving a plurality of discharged sheets in a stacked condition, a cartridge cover 114, an ADF (automatic document feeder) cover 115, an outer original guide 116, an original hold-down plate 117, an inner original guide 118, a partition portion 119 between the image reading portion 103 and the recording apparatus 104, a control portion 120, a sheet convey path 121, and a sheet discharge cover 123.

In the image reading portion 103, the originals S from the original stacking plate 102 are separated one by one by a separation roller 106b and a separation pad 106*a* urged against the separation roller, and the separated original is conveyed, by the convey rollers 106*c*, 106*d* which are urged against each other by an urging spring, through a U-turn sheet path constituted by portions of the outer and inner original guides 116, 118. Further, the original is conveyed to the image sensor 108 of close contact type by the sheet supply rollers 106*e*, 106*f* which are urged against each other by an urging spring. In the image sensor, the image information on the original is read while contacting the original S with the image sensor 108 of close contact type by an elastic force generated by deforming the original hold-down plate 117 by the original urging portion 107. Thereafter, the original S is discharged onto the original discharge tray 109 by the discharge rollers 106*g*, 106*h* which are urged against each other by an urging spring. Meanwhile, the original S is guided by the outer and inner original guides 116, 118.

In the recording apparatus 104, in response to an image signal outputted from the control portion 120, a modulated signal (modulated beam) is emitted from a laser beam generator (not shown) of the laser scanner 110, and the modulated beam is incident on a photosensitive drum 111*a* of the image forming portion 111 through a polygon mirror 110*b*, to thereby form an image (corresponding to the image information) on the photosensitive drum 111*a*. Then, the image is transferred onto the sheet P supplied from the cassette sheet supply portion 112 to the image forming portion 111. Then, the image is fixed to the sheet at a fixing device. Thereafter, the sheet is discharged onto the sheet discharge portion 113.

A transfer charger 111*f* is disposed around the photosensitive drum 111*a* of the image forming portion 111, and a thermal fixing device 111*g* and sheet discharge rollers 111*h* are disposed in a sheet convey path at a downstream side of the photosensitive drum 111*a*. With this arrangement, after the toner image formed on the photosensitive drum 111*a* is transferred onto the sheet P by the transfer charger 111*f*, the sheet is conveyed along the sheet convey path 121 to reach the thermal fixing device 111*g*, where the toner image is fixed to the sheet. Then, the sheet is discharged onto the sheet discharge portion 113 by the sheet discharge rollers 111*h*.

The cassette sheet supply portion 112 is disposed at a bottom of the facsimile machine 101. The sheets P stacked on an intermediate plate 112*e* in a sheet supply cassette 112*a* is biased upwardly by an intermediate plate spring 112*f*. The sheets are separated one by one by a semi-circular sheet supply roller 112*b* and a pair of separation pawls (not shown) (pawl separation) and the separated sheet P is conveyed by a pair of cassette convey rollers 112*c* and then is U-turned or reversely rotated by a sheet convey inner guide 121*c* forming a part of a body frame of the facsimile machine, a cover side U-turn guide 121*d*provided on the front cover 122 and a body side U-turn guide 121*e* provided within the facsimile machine 101. Further, a tip end of the sheet P being supplied is detected by a regist sensor 121*f*. With this arrangement, after a sheet supply timing and an image output timing are selected so that an image tip end of the toner image formed on the photosensitive drum 111*a* coincides with the tip end of the sheet P, the sheet is conveyed between the transfer charger 111*f* and the photosensitive drum 111*a*.

A lateral edge and a rear edge of the sheet P are regulated by sheet regulating plates 112*d* shiftable to regulate the sheet, thereby preventing the skew-feed and poor conveyance of the sheet. The image is formed on a back surface or lower surface of the sheet P supplied from the sheet supply cassette 112*a*.

Next, a first embodiment of the present invention will be explained with reference to FIGS. 1 to 7. In this embodiment, an example that the originals S stacked on the original stacking plate 102 are supplied to the image reading portion 103 of the above-mentioned facsimile machine will be explained.

Figure 1:
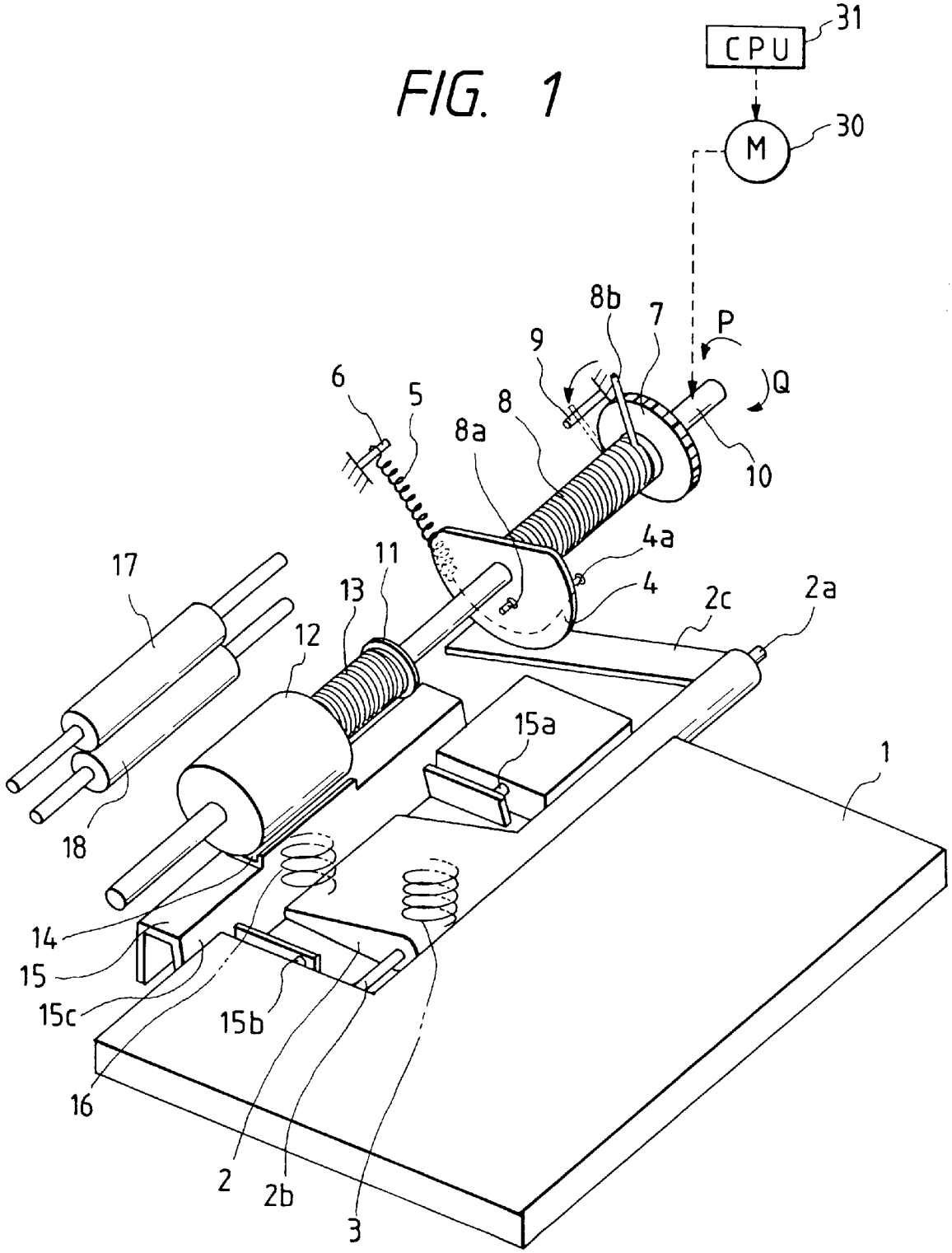
FIG. 1 is a perspective view of a sheet supplying apparatus according to a first embodiment of the present invention in a waiting condition.
Figure 2:
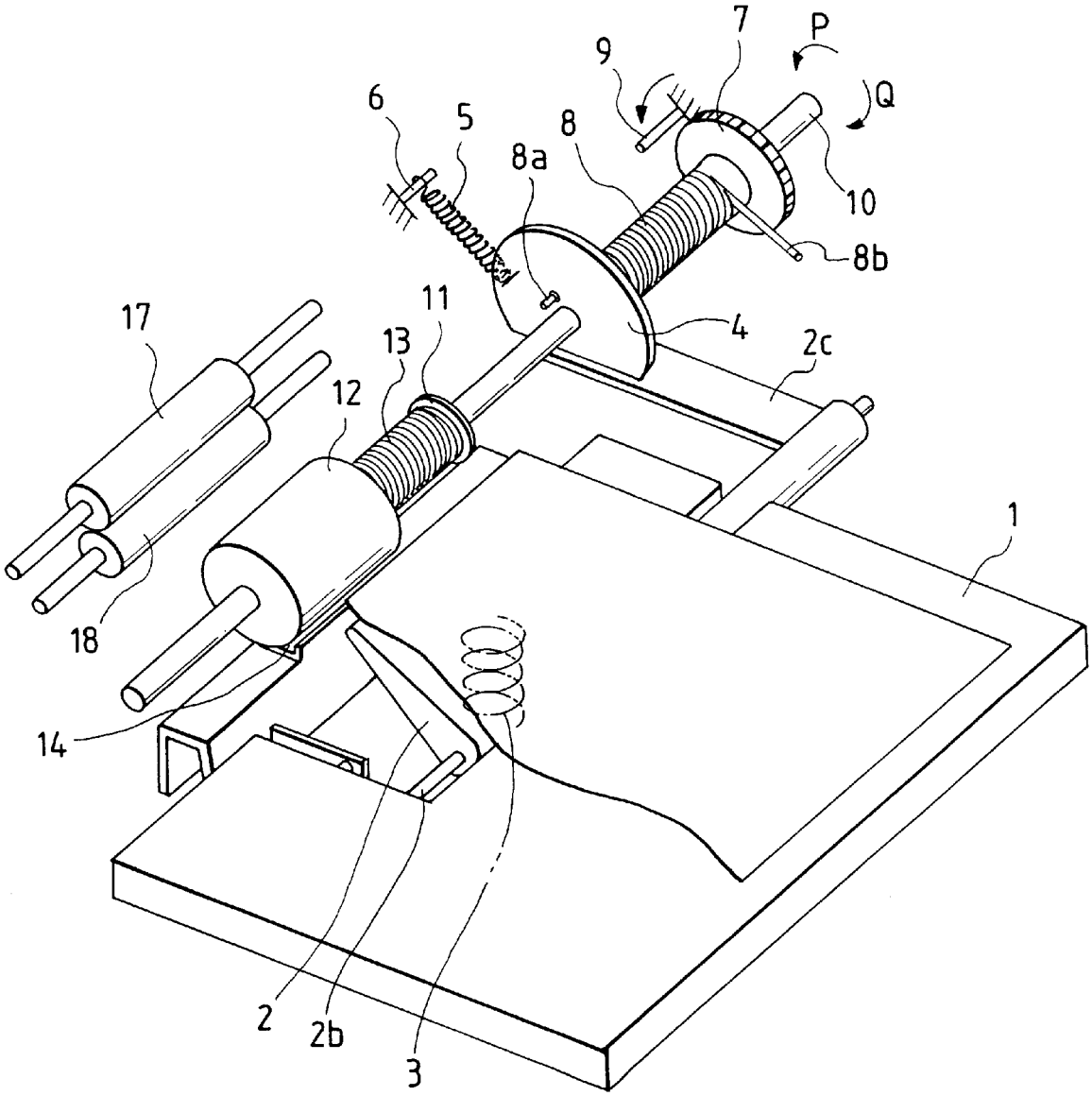
FIG. 2 is a perspective view of the sheet supplying apparatus of FIG. 1 in a sheet supplying condition.
Figure 3:
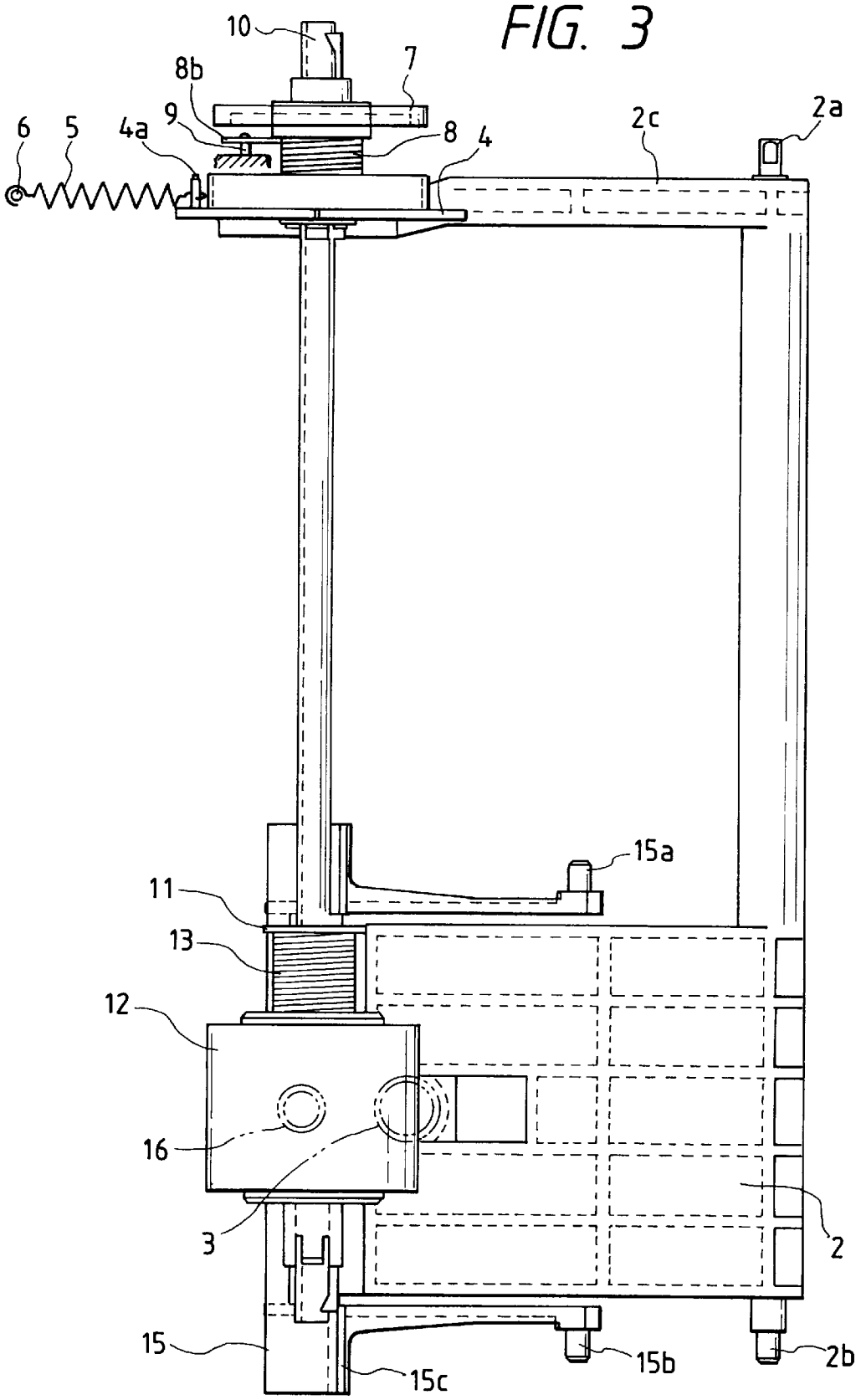
FIG. 3 is a plan view of a main portion of the sheet supplying apparatus of FIG. 1.
Figure 4:
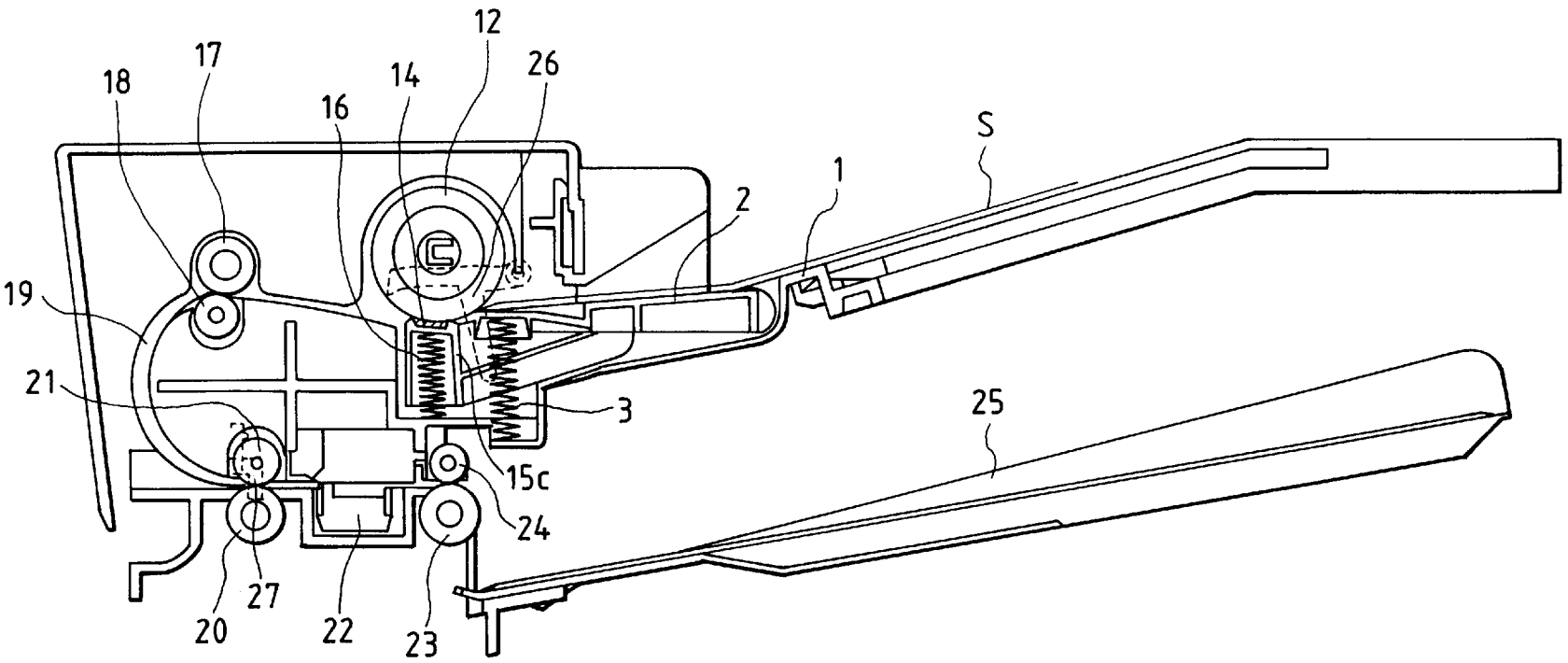
FIG. 4 is a sectional view of an image reading apparatus to which the sheet supplying apparatus of FIG. 1 is applied.

FIGS. 1 and 2 are perspective views of a sheet supplying apparatus according to this embodiment, FIG. 3 is a plan view of the sheet supplying apparatus and FIG. 4 is a sectional view of the sheet supplying apparatus. In FIGS. 1 to 4, the sheet supplying apparatus comprises an original plate (sheet stacking plate) 1, a lifter (sheet urging means) 2 pivotally supported by the original plate 1 via shafts 2*a*, 2*b* and shiftable between a first position where the original stack S rested on the original plate 1 is urged against a separation roller 12 and a second position where the original stack S is spaced apart from the separation roller 12.

The sheet apparatus further comprises a lifter spring (urging means biasing member) 3 for biasing the lifer upwardly (toward the separation roller 12), a lifer cam (cam means) 4 for pushing an arm portion 2*c* of the lifter 2, and a cam return spring 5 connecting between a projection 4*a* on the cam and a spring hook 6.

A separation roller gear 7 serves to transmit a driving force from a motor (stepping motor) 30 as a drive means, and a lifter spring clutch (one-way clutch) 8 serves to transmit only a reverse rotation driving force (driving force directing to a direction P in FIG. 1) from the separation roller gear 7 to the lifter 2. One end 8*a* of the spring clutch 8 is engaged by a hole of the lifter cam 4 and the other end 8*b* of the spring clutch is extended uprightly so that, when the other end 8*b* is rotated by a predetermined angle, it is engaged by a spring clutch end stopper 9. The spring clutch 8 is wound along a sheet conveying direction (anti-clockwise direction in this embodiment).

The separation roller gear 7 is secured to a separation roller shaft 10 to rotate together with the latter. The lifter cam 4 is rotatable with respect to the separation roller shaft 10. A transmission core 11 is secured to the separation roller shaft 10 to rotate together with the latter, and a separation roller (feed-out means) 12 is rotatable with respect to the separation roller shaft 10 to feed out the original. A separation spring clutch (one-way clutch) 13 servers to transmit a normal rotation driving force (driving force directing to a direction Q in FIG. 1) from the transmission core 11 to the separation roller 12, so that the driving force of the separation roller shaft 10 for conveying the original S alone can be transmitted. Further, the separation spring clutch 13 is wound along a direction opposite to the sheet conveying direction (clockwise direction in this embodiment).

A separation pad 14 is opposed to and contacted with the separation roller 12 and is held by a separation pad holder 15 rotatably supported by shafts 15*a*, 15*b*. A portion 15*c* of the holder 15 acts as an original tip end stopper for regulating positions of tip ends of the originals when the originals are set. The separation pad 14 is urged against the separation roller 12 by a separation spring 16 through the separation pad holder 15. The original S separated at a separation portion constituted by the separation roller 12 and the separation pad 14 is conveyed to the downstream original reading portion by a convey roller 17 and a pinch roller 18 urged against the convey roller 17.

In FIG. 4, the reference numeral 19 denotes a U-turn path for U-turning the original S; 20 denotes a sheet supply roller; 21 denotes a pinch roller urged against the sheet supply roller for pinching the original S therebetween; 22 denotes a contact sensor for reading an image on the original; 23, 24 denote a pair of discharge rollers; and 25 denotes a discharge tray. The reference numeral 26 denotes a sensor S1 for detecting presence/absence of the original; and 27 denotes a sensor S2 for detecting the tip and trail ends of the original.

Next, an operation of the sheet supplying apparatus according to the present invention will be explained with reference to FIGS. 1 and 2. FIG. 1 shows a waiting condition of the sheet supplying apparatus of the present invention. Before the waiting condition, the separation gear 7 and the separation roller shaft 10 were rotated in the direction P sufficient to rotate the lifter cam 4 to the position shown in FIG. 1 to thereby lower the arm portion 2*c* of the lifter 2, thereby bringing the lifter 2 to the second position (lowered position) in opposition to the lifter spring 3.

In this condition, one or plural originals are set so that the tip ends of the originals abut against the original tip end stopper portion 15*c* of the separation pad holder 15. Then, when a reading start button (not shown) of the apparatus is depressed, due to the driving force of the motor 30, the separation roller gear 7 and the separation roller shaft 10 are rotated in the normal direction (direction Q). In this case, since the lifter spring clutch 8 is the one-way clutch wound anti-clockwise direction, the transmission torque does not generate, with the result that the lifter cam 4 becomes free and is rotated in the direction Q by the lifter cam return spring 5, thereby releasing the push-down of the arm portion 2*c*.

In response to this action, the lifter 2 is lifted to the first position where the original stack is urged against the separation roller 12, as shown in FIG. 2. On the other hand, since the separation spring clutch 13 is wound in the clockwise direction, the driving force is transmitted from the rotating transmission core 11 secured to the separation roller shaft 10 to the separation roller 12, to thereby rotate the separation roller in the direction Q. As mentioned above, since the original stack S is urged against the separation roller 12 by the lifter 2, only an uppermost original of the original stack is separated from the other originals and is fed out by the separation roller 12 and the separation pad 14, and the fed-out original is pinched between the convey rollers 17, 18 and is conveyed to the image reading portion.

FIG. 4 is an explanatory sectional view showing a condition that the original stack S is urged against the separation roller 12.

After the reading of the original S is finished, when the original is discharged on the discharge tray 25, the motor 30 is controlled by the control portion 31 to be rotated in the reverse direction, thereby rotating the separation roller gear 7 and the separation roller shaft 10 in the direction P. Consequently, the lifter spring clutch 8 is tightened to transmit the reverse rotation driving force of the motor 30 to the lifter cam 4. Thus, the lifter cam 4 is rotated in the direction P to lower the arm portion 2*c* of the lifter 2, with the result that the lifter 2 is lowered to the second position (lowered position) in opposition to the urging force of the lifter spring 3, as shown in FIG. 1.

When the lifter cam 4 is rotated by a predetermined amount, the lifter spring clutch 8 is loosened, thereby preventing the further transmission of the driving force.

When the motor 30 is further rotated by a small amount, the motor is stopped. In this way, the sheet supplying apparatus is brought to the waiting condition. Since the torsion angle (windings) of the lifter spring clutch 8 is so selected that the end 8*b* of the lifter spring clutch 8 is engaged by the stopper 9 when the lifter 2 is completely lowered by the lifter cam 4, the excessive rotation of the lifter cam 4 can be prevented. Further, in this waiting condition, although the lifter cam 4 is biased by the lifter cam return spring 5 toward a direction for releasing the lowering of the lifter 2, if the lifter cam 4 tries to rotate in the direction Q in FIG. 1, the lifter spring clutch 8 is tightened to regulate the rotation of the lift cam. Further, a rotation load of the stopped motor 30 acts on the separation roller shaft 10. Accordingly, the lifter cam 4 is maintained in the waiting condition.

Figure 5A:
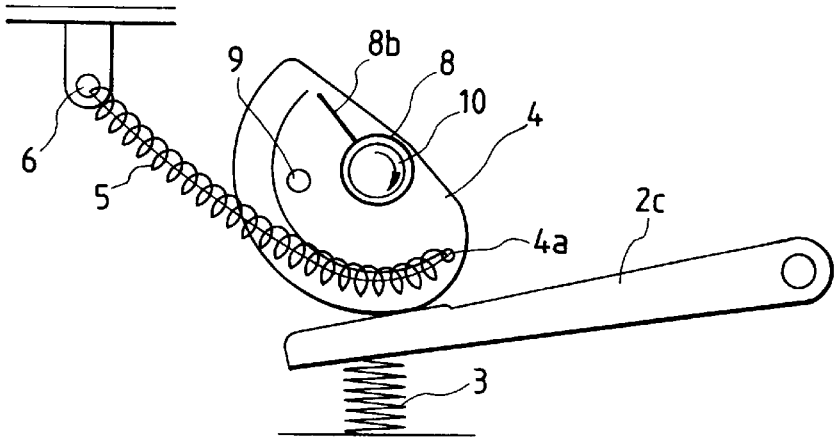
FIGS. 5A to 5C and 6A to 6C are views showing an operation of a cam member in the present invention.
Figure 5B:
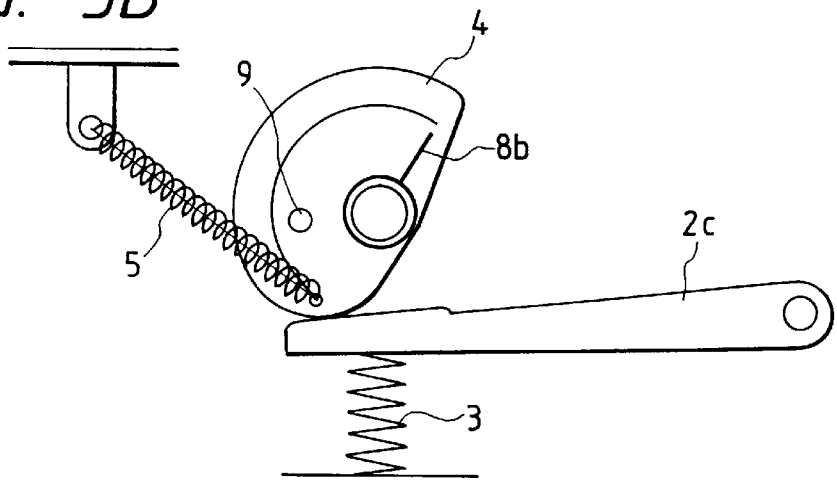
Figure 5C:
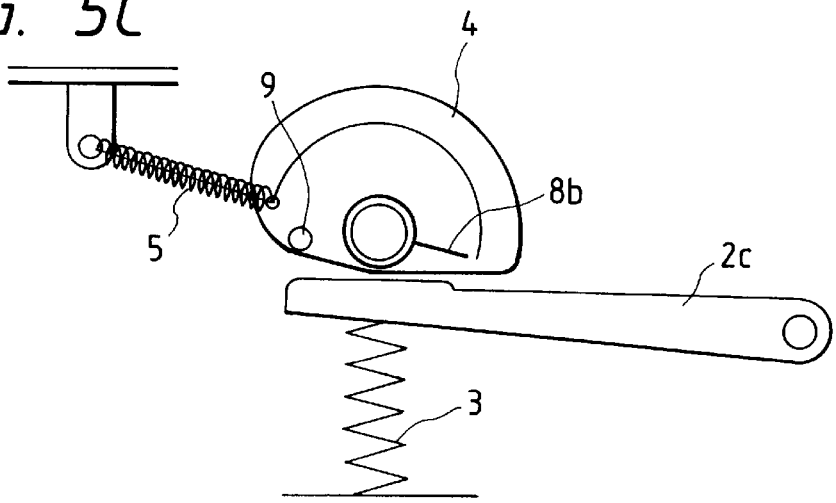
Figure 6A:
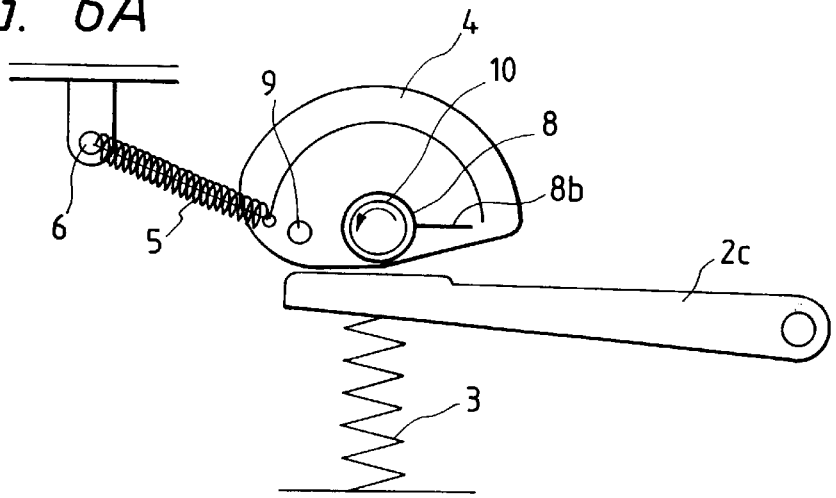
Figure 6B:
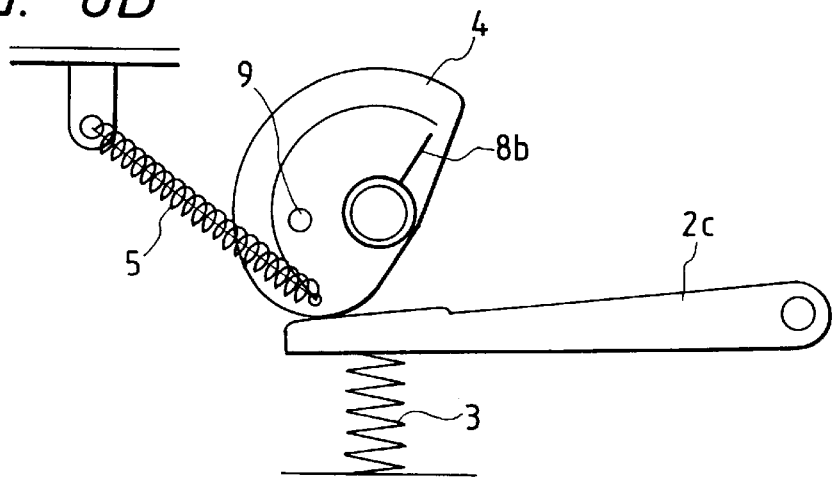
Figure 6C:
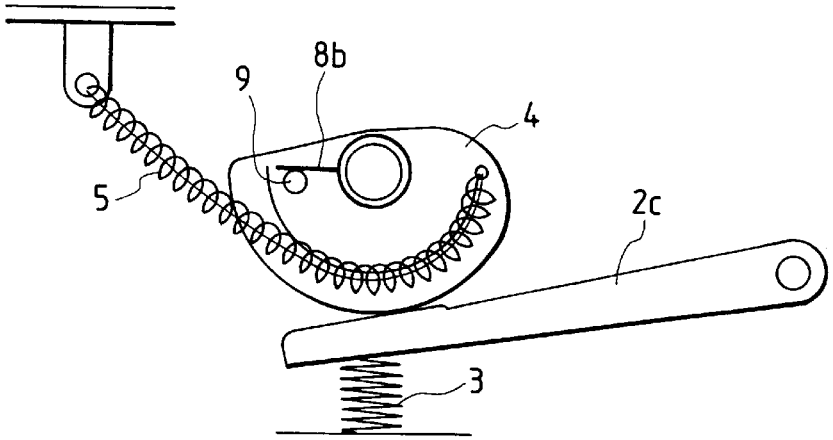

The movement of the lifter cam 4 and the operation of the lifter 2 are shown in FIGS. 5A to 5C and FIGS. 6A to 6C. FIGS. 5A to 5C show a condition that the lifter 2 is shifting from the second position (FIG. 5A) to the first position (FIG. 5C), and FIGS. 6A to 6C show a condition that the lifter 2 is shifting from the first position (FIG. 6A) to the second position (FIG. 6C).

Figure 7:
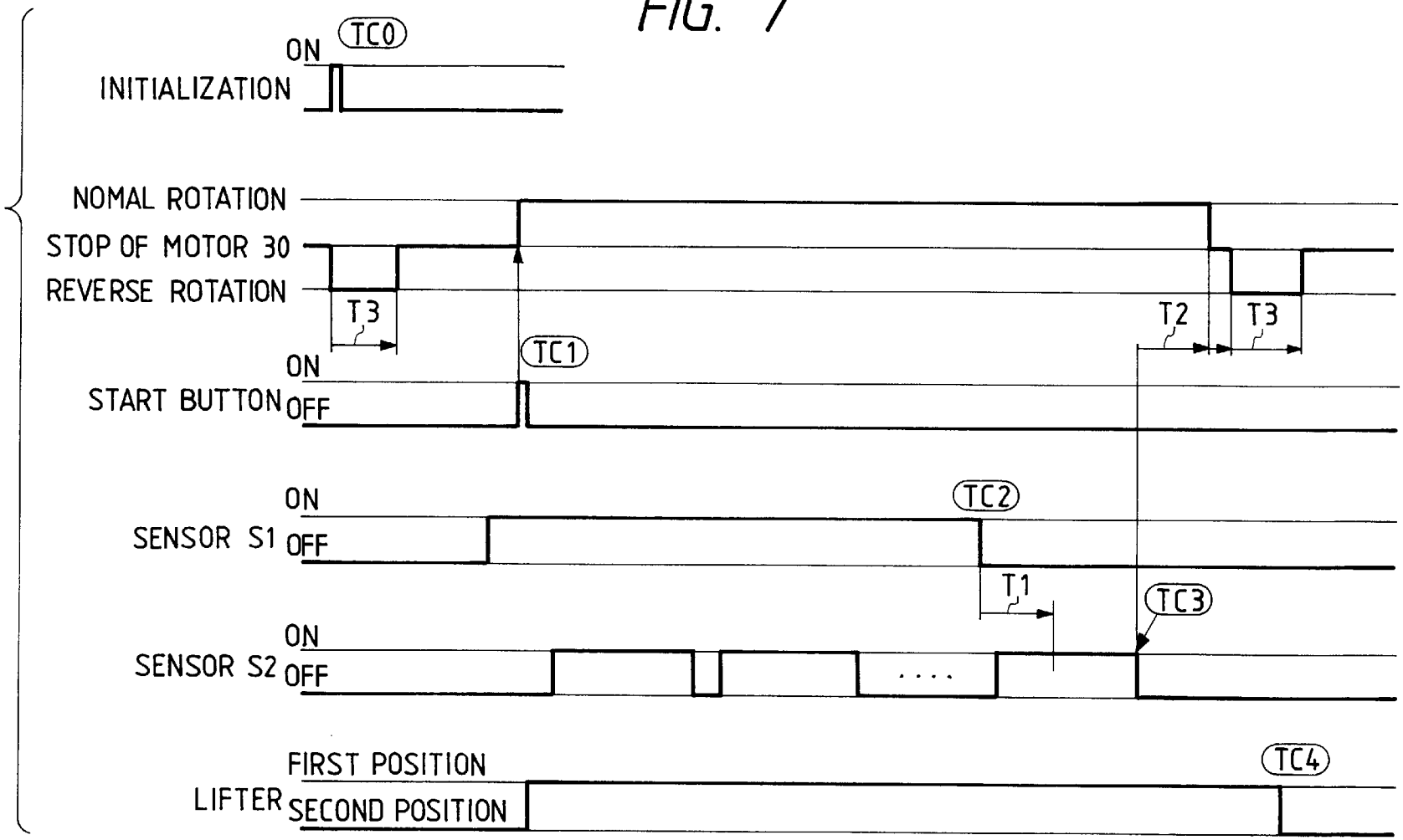
FIG. 7 is a timing chart for explaining an operation of the sheet supplying apparatus of FIG. 1.

FIG. 7 is a timing chart showing timings regarding normal/reverse rotation of the motor 30, ON/OFF of the start button, ON/OFF of the sensors S1, S2. In FIG. 7, three conditions of the motor 30 (normal rotation toward the direction Q, reverse rotation toward the direction P and stop) are shown.

In this waiting condition, the originals S are set on the original plate 1, the sensor S1 is turned ON. Thereafter, when the start button is turned ON (TC1), the motor 30 is rotated in the normal direction to shift the lifter from the second position to the first position. Due to the normal rotation of the motor 30, the original is supplied by the separation roller. After a predetermined number of originals are supplied, and after a predetermined time T1 is elapsed from the timing (TC2) when the trail end of the last original leaves the sensor S1, when the trail end of the last original leaves the sensor S2, the sensor S2 is turned OFF (timing TC3). While the motor 30 is rotated in the normal direction by a predetermined amount T2 from the timing TC2, the originals are completely discharged on the discharge tray 25. Then, after the motor 30 is stopped by a predetermined time, while the motor 30 is being rotated in the reverse direction by a predetermined time T3, the lifter cam 4 is rotated to lower the lifter to the second position, thereby bringing the sheet supplying apparatus to the waiting condition (TC4).

Incidentally, in the illustrated embodiment, upon initialization (TC0), since the motor 30 is rotated reversely by a predetermined time T3 to bring the lifter to the waiting condition (second position), the originals can be set on the original plate.

Figure 8:
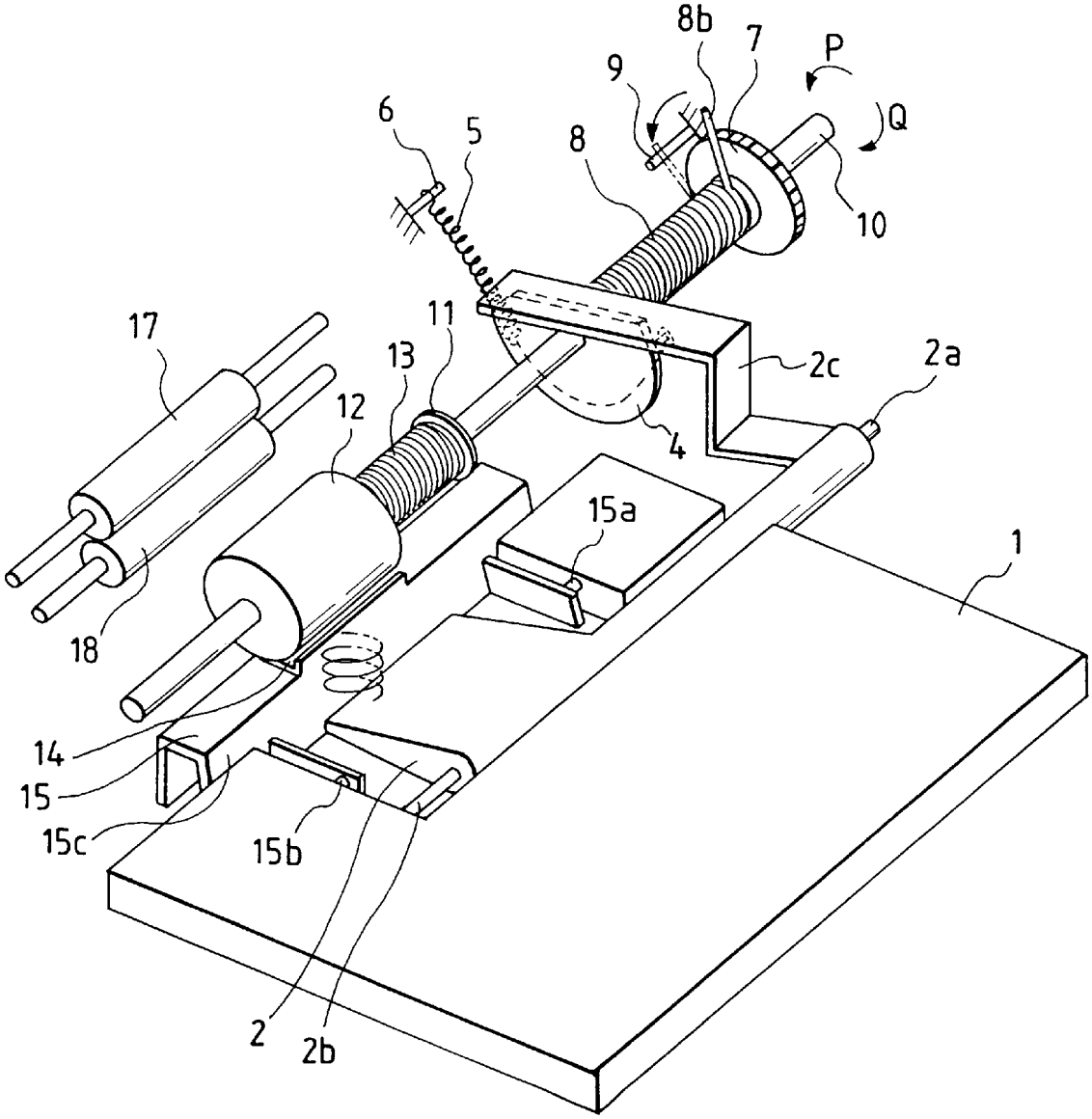
FIG. 8 is a perspective view of a sheet supplying apparatus according to a second embodiment of the present invention.

In the first embodiment, an example that the lifter spring 3 acting as a lifter urging spring is attached to the lifter 2 and the lifter cam return spring 5 acting as a lifter cam returning spring is attached to the lifter cam 4 was explained. However, as shown in FIG. 8, the arm portion 2*c* of the lifter 2 may be disposed above the lifter cam 4 and the lifter 2 may be lifted by a pulling force of the lifter cam return spring 5 when the separation roller shaft 10 is rotated in the direction Q to vanish the torque transmitting force of the lifter spring clutch 8.

In this case, a relation between the rotational directions of the lifter spring clutch 8 and of the shaft 10 and the transmission of the driving force by the lifter spring clutch is the same as that in the first embodiment. When the shaft 10 of the separation roller 12 is rotated in the direction P (reverse direction), the lifter spring clutch 8 transmits the torque to rotate the lifter cam 4, with the result that the lifter 2 is lowered by its own weight. With this arrangement, the lifter spring 3 can be omitted.

In the first embodiment, while an example that the lifter spring clutch is used as a one-way clutch for the separation roller was explained, in place of the spring clutch, a one-way clutch having a different construction may be used. For example, when a needle clutch is used, the response to the driving force transmission is enhanced in comparison with the spring clutch, and a danger of failure due to deformation of the spring can be reduced, thereby improving the reliability of the apparatus.

In the above-mentioned embodiments, an example that the lifter lift/lower mechanism of the sheet supplying apparatus of the present invention is applied to the image reading portion of the facsimile machine was explained, the present invention is not limited to such an example, but may be applied to an image reading portion of a copying machine or an electronic file, or to a sheet supply portion for a recording sheet on which an image is to be formed. In these cases, as is in the first embodiment, it is not required that an exclusive drive means is provided and expensive elements such as a solenoid and an electromagnetic clutch are used.

Figure 9:
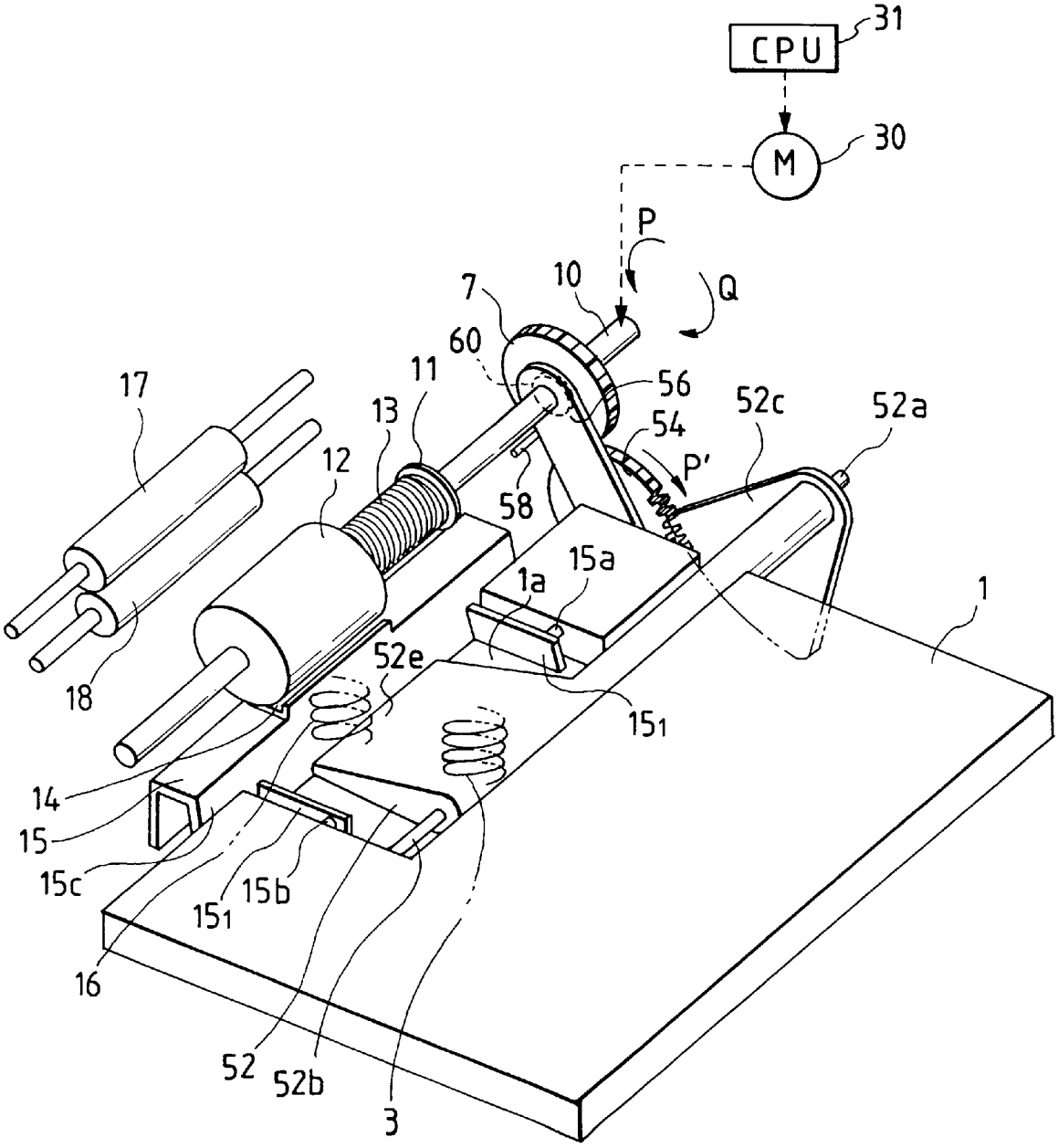
FIG. 9 is a perspective view of a sheet supplying apparatus according to a third embodiment of the present invention in a waiting condition.
Figure 10:
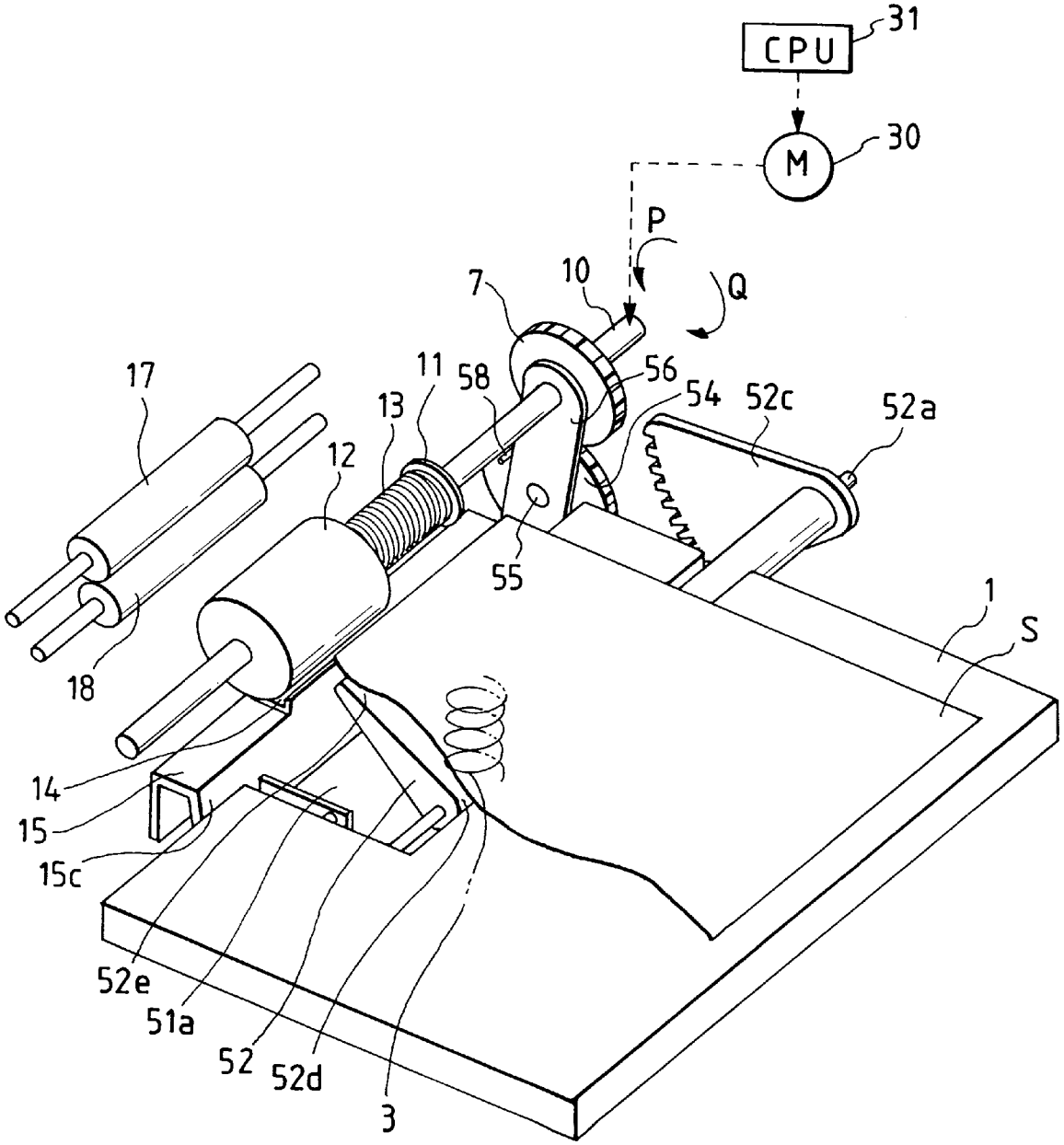
FIG. 10 is a perspective view of the sheet supplying apparatus of FIG. 9 in a sheet supplying condition.
Figure 11:
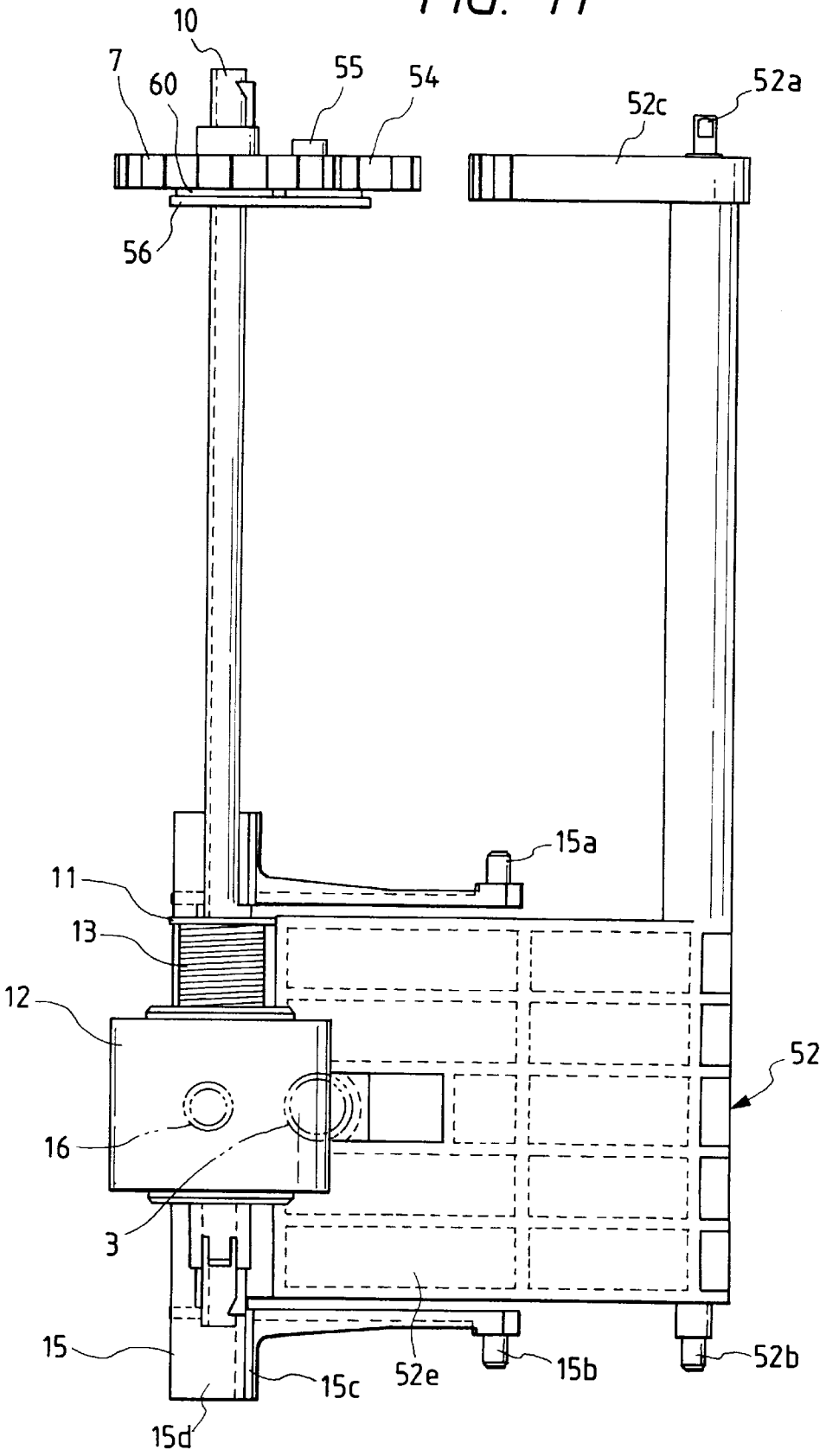
FIG. 11 is a plan view of a main portion of the sheet supplying apparatus of FIG. 9.
Figure 12:
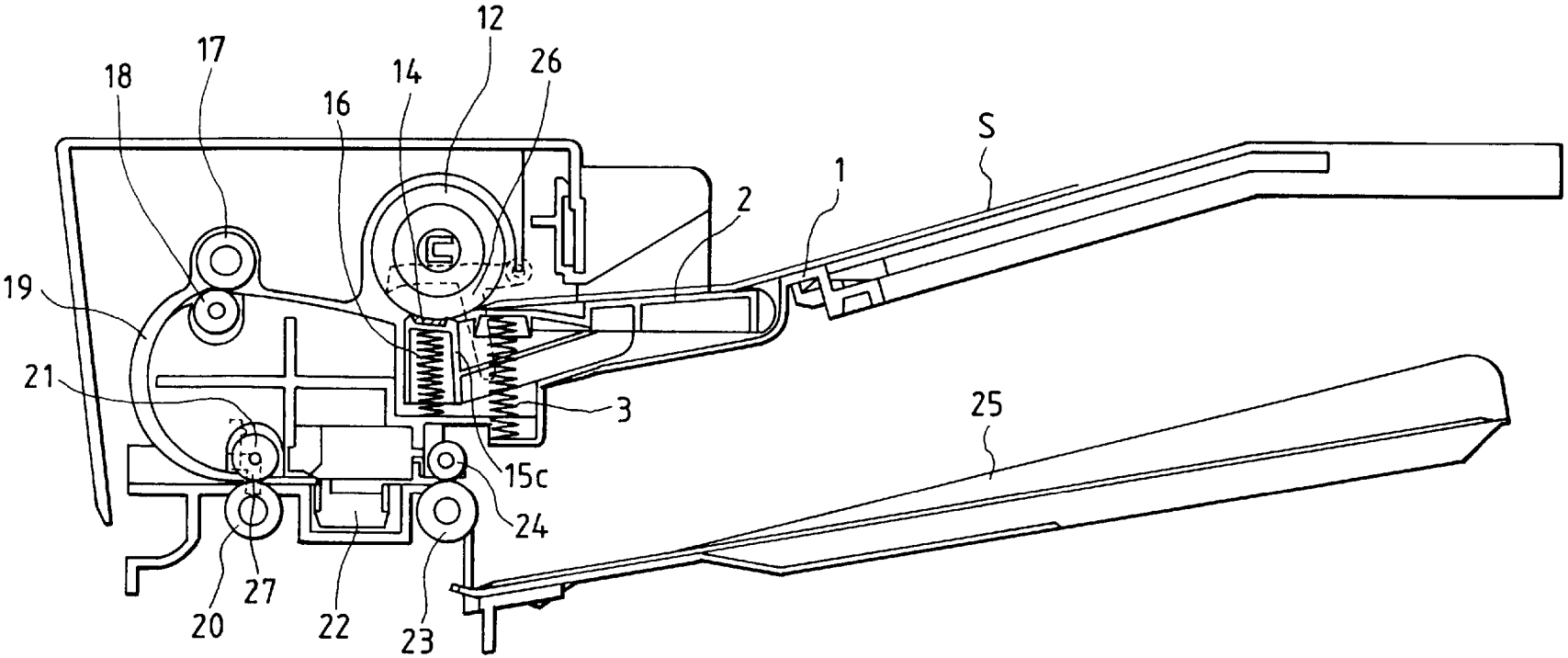
FIG. 12 is a sectional view of an image reading apparatus to which the sheet supplying apparatus of FIG. 9 is applied.

Next, an another embodiment of the present invention will be explained with reference to FIGS. 9 to 12. FIG. 9 is a perspective view of a main portion of a sheet supplying apparatus according to this embodiment, FIG. 10 is a perspective view of the sheet supplying apparatus in an operating condition, FIG. 11 is a plan view of the sheet supplying apparatus, and FIG. 12 is a side sectional view of the sheet supplying apparatus.

In FIGS. 9 to 12, a lifter (sheet urging means) 52 is attached to an original plate (sheet stacking plate) 52 (on which sheets are stacked) for pivotal movement by a predetermined angle. The lifter 52 is engaged by a recessed portion 1*a* of the original plate 1. A lifter sector gear (input member gear) 52*c* is secured to a shaft portion of the lifter, and end portions 52*a*, 52*b* (FIG. 11) are rotatably supported by bearings (not shown). A tongue-shaped sheet urging portion 52*e* of the lifter 52 is always biased upwardly by a spring 3.

A separation roller (supply means) 12 for feeding out the sheets stacked on the original plate 1 and the lifter 52 is connected to a separation roller shaft (drive shaft) 10 through a spring clutch (one-way clutch) 13. As the separation roller shaft 10 is rotated in a direction shown by the arrow Q, when a load directing to a direction (P) opposite to the direction Q acts on the separation roller 12, the spring clutch 13 acts to rotate the separation roller shaft 10 together with the separation roller 12. On the other hand, as the separation roller shaft 10 is rotated in the direction P, when a load directing to the direction (Q) opposite to the direction P acts on the separation roller, the spring clutch 13 acts to effect relative rotation between the separation roller shaft 10 and the separation roller 12. Further, as the separation roller shaft 10 is rotated in the direction Q, if the separation roller 12 is rotated faster than the separation roller shaft 10, the spring clutch 13 acts to effect relative rotation between the separation roller shaft 10 and the separation roller 12.

The separation roller 12 is rotatably supported by bearings (not shown) of the apparatus. A transmission core 11 is secured to the separation roller shaft 10 in engagement with the spring clutch 13, and the transmission core 11 forms a part of the separation roller shaft 10. Further, a first gear 7 connected to a motor (drive source) 30 through the separation roller shaft 10 is secured to the separation roller shaft 10 in a confronting relation to the sector gear 52*c*. An arm 56 is attached to the separation roller shaft 10 at the left (FIG. 9) side of the first gear 7.

Although the arm 56 is rotated integrally with the separation roller shaft 10 owing to frictional resistance from a torque limiter 60 (such as a split washer or a coned disc spring) disposed between the first gear 7 and the arm 56, if the arm 56 is subjected to rotational resistance greater than the frictional resistance, the arm is slipped with respect to the separation roller shaft 10, thereby permitting the relative rotation therebetween. A second gear 54 meshed with the first gear 7 is rotatably supported at an end of the arm 56 via a support pin 55. The second gear 54 is revolved together with the arm 56 around the separation roller shaft 10 to engage with or disengage from the sector gear 52*c*, thereby permitting or inhibiting the transmission of the rotational force of the motor 30 to the sector gear 52*c*. Incidentally, as shown in FIG. 10, the arm 56 can abut against a stopper 58 of the apparatus to regulate a rotational amount of the arm. The first gear 7, arm 56, second gear 54 and torque limiter 60 constitute a gear device.

Incidentally, since the other arrangement is the same as that in the first embodiment, explanation thereof will be omitted.

Next, a fundamental operation of the sheet supplying apparatus according to this embodiment will be explained with reference to FIGS. 9 and 10.

FIG. 9 shows a waiting condition of the sheet supplying apparatus. Before the waiting condition, the separation gear 7 and the separation roller shaft 10 were rotated in the direction P sufficient to rotate the second gear 54 in a direction P' to lower the lifter sector gear 52*c*, thereby bringing the lifter 52 to a lowered position (shown in FIG. 9) in opposition to the spring 3. In this condition, one or plural originals are set so that the tip ends of the originals abut against a reference surface (original tip end regulating stopper portion) 15*c* of the separation pad holder 15. Then, when a reading start button (not shown) of the apparatus is depressed, the separation roller gear 7 and the separation roller shaft 10 are rotated in the direction Q by the motor 30.

In this case, since the arm 56 is rotated in a clockwise direction (FIG. 9) together with the separation gear 7, the second gear 54 is disengaged from the sector gear 52*c*. As a result, the lifter 52 is lifted by the spring 3, to thereby urge the sheet stack (original stack) against the separation roller 12. The arm 56 is stopped by the stopper 58 to prevent the excessive rotation of the arm.

On the other hand, when the separation roller shaft 10 is rotated in the direction Q, the separation spring clutch 13 transmits the rotational force of the motor 30 from the transmission core 11 rotating integrally with the separation roller shaft 10 to the separation roller 12, thereby rotating the separation roller 12 in the direction Q. Only an uppermost sheet of the sheet stack S is separated from the other sheets and is fed out by the separation roller 12 and the separation pad 14, and the fed-out sheet is advanced by the convey rollers 17, 18 along the U-turn path 19 and is conveyed to the image reading portion including the contact sensor 22 (FIG. 12). Incidentally, FIG. 12 is a sectional view of the sheet supplying apparatus in a condition that the lifter 52 is lifted and the sheet stack is urged against the separation roller 12.

After the reading of the image information on the sheet by means of the contact sensor 22 is finished, when the sheet is discharged on the discharge tray 25, the motor (drive source) 30 is controlled by the control portion (CPU) 31 to be rotated in the reverse direction, thereby rotating the separation roller gear 7 and the separation roller shaft 10 in the direction P. Consequently, the arm 56 is rotated together with the separation roller gear 7. When the second gear 54 is engaged by the sector gear 52*c*, since the arm 56 is subjected to the load, the rotation of the arm 56 is stopped, with the result that the rotational force of the motor 30 is transmitted from the second gear 54 to the sector gear 52*c*. As a result, the lifter sector gear 52*c* is rotated in a direction opposite to the direction P' (clockwise direction in FIG. 9), so that the lifter 52 is lowered to the lowered position (lowermost position in FIG. 9) in opposition to the spring 3, as shown in FIG. 9.

Incidentally, in this case, since the separation roller 12 is contacted with the separation pad 14 and is subjected to the frictional resistance from the separation pad 14 not to rotate the roller and since the relative rotation between the separation roller 12 and the separation roller shaft 10 is permitted by the action of the spring clutch 13, the separation roller 12 is maintained in the stopped condition. Thus, the sheets on the original plate 1 can be prevented from floating.

Since the lifter gear 52*c* has a sector shape, when the lifter gear is rotated by the predetermined amount, the lifter gear is disengaged from the second gear 54. As a result, the rotational force of the motor 30 is not transmitted to the lifter 52. Even after the lifter gear 52*c* is disengaged from the second gear 54, the motor 30 continues to rotate by the predetermined amount and then is stopped in response to the control signal from the CPU 31. In this way, the sheet supplying apparatus becomes the waiting condition.

Incidentally, since the sector of the lifter gear 52*c* is so designed that the lifter gear is disengaged from the second gear just when the lifter 52 is lowered to the best position, the excessive rotation of the lifter gear 52*c* can be prevented. That is to say, the damage of the lifter 52 due to the urging force of the original plate 1 can be prevented. Further, the clockwise (FIG. 9) rotation of the lifter gear 52*c* is prevented by abutting it against the second gear 54. The reason is that, since the rotation of the separation roller shaft 10 is regulated by the rotational resistance of the stopped motor 30 and the second gear 54 is stopped in the condition shown in FIG. 9, the lifter 52 is regulated by the second gear 54. Thus, the position of the lifter 52 is ensured.

As mentioned above, according to this embodiment, without using expensive electrical elements such as a solenoid and an electromagnetic clutch, the lifter 52 can be operated with a simple mechanical arrangement, to thereby make the sheet supplying apparatus compact and cheaper.

Incidentally, since a timing chart of this embodiment is the same as that in the first embodiment, explanation thereof will be omitted.

What is claimed is:

1. A sheet supplying apparatus comprising:

sheet supporting means for supporting at least one sheet;

sheet supply means for feeding out the sheet supported by said sheet supporting means;

drive means generating one-way and other-way rotating forces;

shift means for shifting said sheet supporting means between a sheet supply position where the sheet supported by said sheet supporting means is contacted with said sheet supply means, and a waiting position where the sheet is spaced apart from said sheet supply means;

clutch means for transmitting only the one-way rotating force generated by said drive means to said shift means; and auxiliary shift means for shifting said shift means to cause said sheet supporting means to move in a direction opposite to a shifting direction of said sheet supporting means by said shift means through the one-way rotating force transmitted by said clutch means, when the other-way rotating force is generated by said drive means.

2. A sheet supplying apparatus according to claim 1, wherein said sheet supporting means is a rockable lifter for supporting the sheet, said shift means is a cam member capable of rocking said lifter by abutting against said lifter, and said clutch means is a one-way clutch.

3. A sheet supplying apparatus according to claim 2, further comprising an elastic member for biasing said lifter toward the sheet supply position, wherein said cam member is rotated by the rotating force transmitted by said one-way clutch to shift said lifter to the waiting position in opposition to an elastic force of said elastic member.

4. A sheet supplying apparatus according to claim 3, wherein said auxiliary shift means is a spring member for forcibly rotating said cam member when the other-way rotating force is generated by said drive means and said one-way clutch does not transmit the other-way notating force to said cam member, and said lifter is shifted to the sheet supply position by the elastic force of said elastic member when said cam member is separated from said lifter by rotating said cam member by said spring member.

5. A sheet supplying apparatus according to claim 2, wherein said cam member shifts said lifter to the waiting position when the rotating force of said drive means is transmitted to said cam member through said one-way clutch to rotate said cam member to thereby separate it from said lifter, and said cam member shifts said lifter to the sheet supply position by rotating said cam member by said auxiliary shift means when the rotating force of said drive means is not transmitted to said cam member through said one-way clutch.

6. A sheet supplying apparatus according to claim 5, wherein said auxiliary shift means is a spring member for rotating said cam member, and said lifter is biased toward the sheet supply position by an elastic force of said spring member through said cam member when said cam member abuts against said lifter.

7. A sheet supplying apparatus according to claim 5, wherein, when said cam member is separated from said lifter, said sheet supporting means is shifted to the waiting position by its own weight.

8. A sheet supplying apparatus according to claim 2, wherein said one-way clutch includes a coil spring for permitting the transmission of rotating force when the coil spring is subjected to the one-way rotating force to be tightened and for inhibiting the transmission of the rotating force when the coil spring is subjected to the other-way rotating force to be loosened, and includes a stopper for releasing tightness of said coil spring to prevent excessive rotation of said cam member when the one-way rotating force is transmitted to said cam member.

9. A sheet supplying apparatus according to claim 1, further comprising a one-way clutch disposed between said drive means and said sheet supply means for transmitting only the one-way rotating force of said drive means to rotate said sheet supply means in the sheet supplying direction.

10. A sheet supplying apparatus according to claim 1, wherein said clutch means includes a first gear to which rotating force of said drive means is transmitted, an arm rocked in accordance with a rotational direction of said first gear, and a second gear attached to said arm and meshed with said first gear, and said shift means is a third gear connected to said sheet supporting means and engageable with said second gear, wherein, when the one-way rotating force is generated by said drive means, said arm is rocked to engage said second gear by said third gear to thereby transmit the one-way rotating force for shifting said sheet supporting means, and, when the other-way rotating force is generated by said drive means, said arm is rocked to disengage said second gear from said third gear for inhibiting the transmission of the other-way rotating force.

11. A sheet supplying apparatus according to claim 10, wherein said auxiliary shift means is a spring member for shifting said sheet supporting means in a direction opposite to a direction in which said sheet supporting means is shifted by said shift means to which the one-way rotating force is transmitted from said clutch means, and said sheet supporting means is shifted by said spring member when the transmission of the other-way rotating force is interrupted.

12. A sheet supplying apparatus according to claim 11, wherein said shift means shifts said sheet supporting means to the waiting position by the one-way rotating force of said drive means, and, said auxiliary shift means shifts said sheet supporting means to the sheet supply position and rotates said sheet supply means in a sheet feeding direction by the other-way rotating force.

13. A sheet supplying apparatus according to claim 10, wherein said third gear is a sector gear, said sector gear meshing with said second gear and rotated by a predetermined amount to be disengaged from it, thereby regulating a shifting amount of said sheet supporting means.

14. A sheet supplying apparatus according to claim 12, further comprising a one-way clutch disposed between said drive means and said sheet supply means for permitting only the transmission of the one-way rotating force of said drive means to thereby rotate said sheet supply means in the sheet feeding direction.

15. A sheet supplying apparatus according to claim 10, further comprising a torque limiter disposed between said first gear and said arm, wherein said torque limiter rotates said arm with predetermined torque in accordance with a rotational direction of said first gear.

16. A sheet supplying apparatus according to claim 1, wherein said sheet supply means is driven by the one-way rotating force generated by said drive means.

17. An image reading apparatus comprising:

sheet supporting means for supporting at least one sheet;

sheet supply means for feeding out the sheet supported by said sheet supporting means;

drive means generating one-way and other-way rotating forces;

shift means for shifting said sheet supporting means between a sheet supply position where the sheet supported by said sheet supporting means is contacted with said sheet supply means, and a waiting position where the sheet is spaced apart from said sheet supply means;

clutch means for transmitting only the one-way rotating force generated by said drive means to said shift means; and auxiliary shift means for shifting said shift means to cause said sheet supporting means to move in a direction opposite to a shifting direction of said sheet supporting means by said shift means through the one-way rotating force transmitted by said clutch means, when the other-way rotating force is generated by said drive means; and reading means for reading an image on the sheet fed out by said sheet supply means.

18. A sheet supplying apparatus comprising:

sheet supporting means for supporting at least one sheet;

sheet supply means for feeding out the sheet supported by said sheet supporting means;

shift means for shifting said sheet supporting means between a sheet supply position where the sheet supported by said sheet supporting means is contacted with said sheet supply means, and a waiting position where the sheet is spaced apart from said sheet supply means;

drive means generating one-way and other-way rotating forces;

clutch means for transmitting only the one-way rotating force generated by said drive means to said shift means so that said shift means shifts said sheet supporting means from said sheet supply position to said waiting position; and auxiliary shift means for causing said shift means to shift said sheet supporting means from said waiting position to said sheet supply position, when the other-way rotating force is generated by said drive means.

19. A sheet supplying apparatus according to claim 18, wherein said sheet supporting means has a rockable lifter for supporting the sheets, and said shift means has a cam member which is rotated by the one-way rotating force transmitted via said clutch means, wherein, when said cam member is rotated, said cam member moves said lifter from said sheet supply position to said waiting position.

20. A sheet supplying apparatus according to claim 19, wherein said sheet supporting means has a spring which biases said lifter toward to said sheet supply position, said cam member moves said lifter to said waiting position against a bias force of said spring when said cam member is rotated by the one-way rotating force.

21. A sheet supplying apparatus according to claim 19, wherein said auxiliary shift means has a spring for rotating said cam member so as to move said lifter from said waiting position to said sheet supply position when the other-way rotating force is generated by said drive means.

22. A sheet supplying apparatus according to claim 18, wherein said sheet supply means is driven by the one-way rotating force generated by said drive means.

23. An image forming apparatus comprising:

sheet supporting means for supporting at least one sheet;

sheet supply means for feeding out the sheet supported by said sheet supporting means;

shift means for shifting said sheet supporting means between a sheet supply position where the sheet supported by said sheet supporting means is contacted with said sheet supply means, and a waiting position where the sheet is spaced apart from said sheet supply means;

drive means generating one-way and other-way rotating forces;

clutch means for transmitting only the one-way rotating force generated by said drive means to said shift means so that said shift means shifts said sheet supporting means from said sheet supply position to said waiting position;

auxiliary shift means for causing said shift means to shift said sheet supporting means from said waiting position to said sheet supply position, when the other-way rotating force is generated by said drive means; and recording means for recording an image on the sheet fed out by said sheet supply means.

* * * * *

UNITED STATES PATENT AND TRADEMARK OFFICE

CERTIFICATE OF CORRECTION

PATENT NO. : 5,909,872

DATED : June 8, 1999

INVENTOR(S) : KOJI TAKAHASHI

It is certified that error appears in the above-indentified patent and that said Letters Patent is hereby corrected as shown below:

COLUMN 4,
Line 58, "121dprovided" should read --121d provided--.

COLUMN 5,
Line 26, "lifer" should read --lifter--.

COLUMN 8,
Line 26, "an" should be deleted.

COLUMN 11,
Line 22, "notating" should read --rotating--.

FIGURE 7,
"NOMAL" should read --NORMAL--.

Signed and Sealed this

Twenty-third Day of November, 1999

*Attest:*

Q. TODD DICKINSON

*Attesting Officer*

*Acting Commissioner of Patents and Trademarks*